US006240975B1

(12) United States Patent
Hehle et al.

(10) Patent No.: US 6,240,975 B1
(45) Date of Patent: Jun. 5, 2001

(54) METHOD AND ARRANGEMENT FOR LIMITING THE LOOM SHED OPENING ANGLE

(75) Inventors: Josef Hehle, Hoerbranz (AT); Werner Birner, Lindau-Bodolz (DE); Herbert Reinhardt, Achberg (DE); Peter Czura, Wangen (DE); Hans-Dieter Scorl, Lindau (DE)

(73) Assignee: Lindauer Dornier Gesellschaft mbH, Lindau (DE)

( * ) Notice: Subject to any disclaimer, the term of this patent is extended or adjusted under 35 U.S.C. 154(b) by 0 days.

(21) Appl. No.: 09/580,285

(22) Filed: May 30, 2000

(30) Foreign Application Priority Data

May 28, 1999 (DE) ..... 199 24 689

(51) Int. Cl.[7] ..... D03D 47/48; D03C 11/00
(52) U.S. Cl. ..... 139/434
(58) Field of Search ..... 139/434, 430, 139/55.1

(56) References Cited

U.S. PATENT DOCUMENTS

| | | | | |
|---|---|---|---|---|
| 2,938,547 | * | 5/1960 | Dewas | 139/434 |
| 4,485,848 | | 12/1984 | Eisenlohr . | |
| 4,554,950 | * | 11/1985 | Sancini et al. | 139/434 |
| 5,649,570 | | 7/1997 | Wahhoud et al. . | |
| 5,803,135 | | 9/1998 | Wahhoud et al. . | |

FOREIGN PATENT DOCUMENTS

| | | |
|---|---|---|
| 0083905 | 7/1983 | (EP) . |
| 0534429 | 3/1993 | (EP) . |
| 837656 | 2/1939 | (FR) . |
| 1494833 | 9/1967 | (FR) . |
| 2262139 | 9/1975 | (FR) . |
| 1327924 | 8/1973 | (GB) . |

* cited by examiner

*Primary Examiner*—Andy Falik
(74) *Attorney, Agent, or Firm*—W. F. Fasse; W. G. Fasse

(57) ABSTRACT

A method and a device limit the normal shed opening angle ($\alpha$) of warp threads in an open loom shed, to a smaller limited shed opening angle ($\alpha 1$) that applies to the selvedge warp threads over a selvedge laying-in width at the edge of the fabric. The limited shed opening angle ($\alpha 1$) is smaller than the normal shed opening angle ($\alpha$) and is selected to provide optimal positioning and binding-in of the free thread end of a beat-up weft thread that is guided back and laid or tucked into the next open shed to form a high quality laid-in selvedge. The shed opening limit device includes two thread-constraining prongs that extend perpendicularly to the direction of the warp threads at least along the desired laid-in depth of the selvedge. The selvedge warp threads are guided and constrained between the prongs so that the extent of shed opening of the selvedge warp threads is limited to the limited angle ($\alpha 1$).

23 Claims, 1 Drawing Sheet

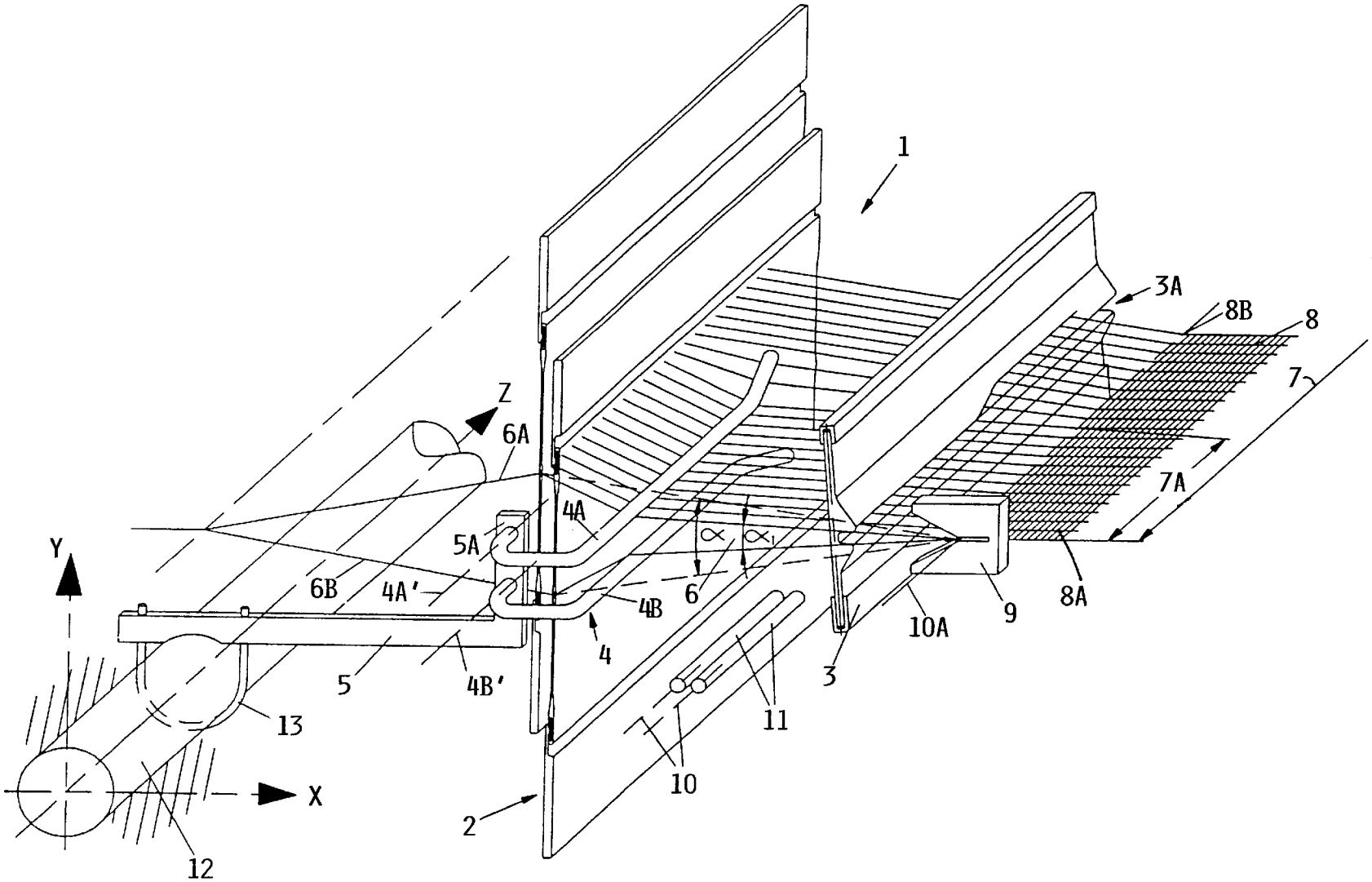
1
2
3
3A
4
4A
4B
4A'
4B'
5
5A
6
6A
6B
7
7A
8
8A
8B
9
10
10A
11
12
13
X
Y
Z
α

METHOD AND ARRANGEMENT FOR LIMITING THE LOOM SHED OPENING ANGLE

PRIORITY CLAIM

This application is based on and claims the priority under 35 U.S.C. §119 of German Patent Application 199 24 689.0, filed on May 28, 1999, the entire disclosure of which is incorporated herein by reference.

FIELD OF THE INVENTION

The invention relates to a method and a device for limiting the weaving shed opening angle, especially in a loom that manufactures a fabric having at least one laid-in selvedge of a predetermined laid-in depth. The method and device relate to looms in which the free end of at least one bound-in weft thread in a front shed is guided back and tucked or laid into a subsequent front shed by means of at least one air jet. The weaving shed is formed by shedding mechanisms and consists of main or lower warp threads and face or upper warp threads, and would normally have a shed opening angle $\alpha$ in the area of the fabric beat-up edge.

The free weft thread end that is guided into the subsequent shed is beat-up against the fabric beat-up edge together with at least one subsequent weft thread by means of a reed within the subsequent weft insertion period and is then bound-in to form the laid-in selvedge.

BACKGROUND INFORMATION

When manufacturing a length of fabric having at least one laid-in selvedge formed by means of a pneumatically actuated laying-in inserter or tucker, for example a laid-in selvedge on the weft thread insertion side, the weft threads are conventionally guided back into a subsequently opened front shed (weaving shed) by means of an airstream. It has been observed that these weft threads poke out through openings between adjacent selvedge warp threads of the upper and lower sheds respectively. In other words, the ends of the weft threads that are guided back into a shed do not remain in the intended position between the face and main warp threads so as to be properly bound in, but instead some thread ends stick out from the plane of the finished selvedge. As a result, the woven selvedge is not of high quality.

SUMMARY OF THE INVENTION

In view of the above, it is an object of the invention to provide a method of maintaining the end of a bound-in weft thread that is guided by means of at least one airstream back into an open weaving shed in the specified position between the main and face warp threads. It is a further object to provide a device for carrying out the method. The invention further aims to avoid or overcome the disadvantages of the prior art and to achieve additional advantages, as are apparent from the present specification.

The above objects have been achieved according to the invention by providing a method of limiting the front shed opening angle a that is formed between the upper and lower sheds by shedding mechanisms, to a limited shed opening angle $\alpha 1$. The limited shed opening angle $\alpha 1$ is smaller than the normal shed opening angle $\alpha$ and extends at least across the laid-in depth of the laid-in selvedge to be formed, viewed in the weaving or warp direction. The normal shed opening angle $\alpha$ is defined as the angle between two lines, of which a first line extends from the beat-up edge to the point of maximum upper shedding deflection of the upper or face warp threads by the respective upper heddles or the like of the shedding mechanism, and of which a second line extends from the beat-up edge to the point of maximum lower shedding deflection of the lower or main warp threads by the respective lower heddles or the like of the shedding mechanism, in a given open loom shed. In other words, the normal shed opening angle $\alpha$ is the angle between the upper and lower warp threads in an open shed if no special measures are taken to limit the opening angle of the warp threads.

By limiting the shed opening angle to a smaller angle $\alpha 1$ at least over the laid-in depth, the method according to the invention provides the advantage that an oscillating or fluttering motion of the free weft thread end is limited in the direction of the face and main warp threads. In this context, at least one airstream that guides the free end of the weft thread back into the weaving shed can act more directly upon the end of the weft thread when the front shed at the fabric edge does not open as wide as the conventional or normal front shed opening.

A shed opening limit device is provided according to the invention to implement the method according to the invention. The shed opening limit device comprises a support beam, a support beam extension, and a two-pronged or two-tined construction. The support beam extension is angled from the support beam and extends in the vertical direction of the weaving shed opening. The two-pronged construction is mounted on the support beam extension and has a first prong or tine and a second prong or tine that are arranged parallel to each other along their axes and spaced vertically apart from each other. The two prongs are fastened to the support beam extension outside and lateral to the front shed area. The first or upper prong and the second or lower prong each have a free end that extends across the front shed for a distance corresponding to the predetermined laid-in depth of the laid-in selvedge, at approximately a right angle to the direction of the warp of the front shed. The respective face and main warp threads of the front shed are guided between the two prongs of the limit device, which are spaced at an adequate distance from the reed and from the shedding mechanism respectively.

As the front shed opens, the warp threads of the upper and lower sheds at least near the edges of the weaving width are forced against the respective upper and lower prongs, whereby their further opening travel is stopped or limited. This effectively limits the conventional shed opening angle $\alpha$ of the front shed formed directly by the shedding mechanisms to a limited shed opening angle $\alpha 1$ that is smaller than the conventional shed opening angle $\alpha$. Also, the limited shed opening angle $\alpha 1$ is defined by the vertical spacing between the two prongs of the limiting device and by the horizontal spacing between the prongs and the beat-up edge, which are adjustable.

The shed opening limit device is slidable within the front shed, that is, it is slidably adjustable between the shedding mechanism and the reed along X, Y and Z planes or axes. The two prongs themselves are adjustable at the support beam extension about their arrangement axis. In this way, the limited shed opening angle $\alpha 1$ of the respective selvedge warp threads of the upper and lower sheds can be optimally adjusted. To adjust the support beam along the X, Y, and Z axes, the free end of the support beam is releasably connected to a suitable fixed part of the loom by any known appropriate releasable fastening means.

BRIEF DESCRIPTION OF THE DRAWINGS

In order that the invention may be clearly understood, it will now be described in connection with an example embodiment, with reference to the accompanying FIGURE that shows a schematic representation of an embodiment of the shed opening limit device according to the invention arranged on a loom between the shedding mechanism and the reed.

DETAILED DESCRIPTION OF A PREFERRED EXAMPLE EMBODIMENT AND OF THE BEST MODE OF THE INVENTION

The FIGURE shows a shed opening limit device 4 according to the invention mounted on a weaving machine or loom 1 and arranged between a shedding mechanism 2 and a reed 3 of the loom 1. The overall loom 1 is not shown, but rather only the reed 3, the shedding mechanism 2 (e.g. heddles, heald frame, etc.) and a machine frame part 12 of the loom are schematically illustrated. These general loom components may have any conventional form.

The shed opening limit device 4 includes a forked or two-pronged construction having a first prong 4A and a second prong 4B that are attached to a support beam extension SA. The support beam extension 5A is a vertical extension of a support beam 5 that is mounted on the loom 1 in a plane that is approximately parallel to a weaving plane that is not expressly defined. The prongs 4A, 4B are arranged in the loom 1 such that their respective axes extend parallel to each other and at a substantially right angle relative to the direction of the warp threads. The prongs 4A, 4B extend across the face warp threads 6A and the main warp threads 6B in the selvedge area of the warp to a predetermined width 7A of the total width 7 of the fabric. Thereby, the warp threads 6A and 6B are received and constrained between the two prongs 4A and 4B. The predetermined width 7A corresponds approximately to the width of a laid-in selvedge 8A, i.e. the laying-in depth. As can be seen in the FIGURE, the free ends of the prongs 4A, 4B are slightly bent or angled away from the planes of the respective upper and lower warp threads such that they will not collide with the face warp threads 6A or the main warp threads 6B in the area of the main width or body of the woven web because these warp threads are not to be included in the limited weaving shed opening.

As shown in the FIGURE, the shed opening limit device 4 constrains a portion of the front shed 6 so as to limit the conventional shed opening angle $\alpha$ between the shedding mechanism 2 and the reed 3, to a limited shed opening angle $\alpha$1. The front shed 6 extends from the respective shedding device of the shedding mechanism 2 to a beat-up edge 8B of the fabric or woven web 8. A so-called pneumatic lay-in inserter or tucker 9 is arranged laterally next to the front shed 6, in the vicinity of the beat-up edge 8B of the fabric 8. The inserter 9 pneumatically engages or entrains a free end 10A of a weft thread 10 that has been beat-up against the beat-up edge 8B by the reed 3 and bound-in by the warp threads through a shed change, and pneumatically inserts the free end 10A into a new front shed 6 for forming a woven edge or laid-in selvedge.

The method according to the invention limits the shed opening angle $\alpha$ to a limited shed opening angle $\alpha$1 of the selvedge warp threads. This limited shed opening angle $\alpha$1 reduces the amount of fluttering of the free end 10A of the weft thread 10 in the vertical direction when it is pneumatically inserted or tucked back into the next open weft shed. This reduced fluttering of the weft thread end 10A makes it much less likely that the weft thread end 10A will poke through an open area between the main warp threads 6B or between the face warp threads 6A in the laid-in depth or width 7A. In this way the known conventional inadequacies of such a woven edge are avoided.

The prongs 4A and 4B of the shed opening limit device 4 are adjustable at the support beam extension 5A about a respective arrangement axis 4A' and 4B', so that the vertical spacing between the prongs 4A and 4B can be adjusted. Also, the overall position of the limit device 4 can be adjusted in the X, Y and Z-directions relative to the loom components as will be discussed below. Thus, the limited shed opening angle $\alpha$1 can be optimally adjusted to correspond to the conditions of the selvedge formation, and particularly to achieve the optimum required limited angle $\alpha$1 of the selvedge warp threads over the optimum width 7A, without interfering with normal weaving operations. The optimum limited angle $\alpha$1 is especially determined with respect to the position of the end 10A of the weft thread 10 that is to be guided back into a shed. In this way the shed opening angle $\alpha$ is adjusted to the appropriate limited shed opening angle $\alpha$1 over the laid-in depth or width 7A.

As mentioned above, when adjusting the limited shed opening angle $\alpha$1, care must be taken that the limited shed opening angle $\alpha$1 is wide enough so that it does not impair the weft thread insertion of weft threads 10 into the weaving shed 6, for example by means of one or more insertion nozzles or jets 11. Thus, for example as shown in the FIGURE, the limited shed opening angle $\alpha$1 is smaller than the conventional shed opening angle $\alpha$, but may not be smaller than the clearance height of the particular weft thread insertion channel 3A in the reed 3. Similarly, on looms with mechanical weft insertion devices such as grippers on rapiers or tapes, the limited angle $\alpha$1 must be greater than the necessary clearance height of the particular insertion devices.

The support beam 5 of the limit device 4 is fastened to a suitable stable machine frame part 12 of the loom 1 by a releasable fastening element 13 (such as a U-bolt, bracket, clamp or bolts) so that the support beam 5 is adjustable in the X, Y and Z axial directions. This provides further possibilities for positioning the shed opening limit device 4 over the face warp and main warp threads 6A, 6B as shown in the FIGURE. By adjusting the limit device 4 along the Z axis, for example, the shed opening limit device 4 can be adjusted to a desired laid-in depth or width 7A, assuming that the prongs 4A, 4B of the limit device 4 have the appropriate length. An adjustment in the X-direction positions the prongs 4A, 4B for the proper clearance between the shedding mechanism 2 and the reed 3, and an adjustment in the Y-direction positions the prongs to a proper height relative to the weaving plane. Each prong 4A, 4B can have a cross-section that is circular, or at least has a rounded contour on a surface contacting the warp threads for smoothly guiding the warp threads.

Although the invention has been described with reference to specific example embodiment, it will be appreciated that it is intended to cover all modifications and equivalents within the scope of the appended claims. It should also be understood that the present disclosure includes all possible combinations of any individual features recited in any of the appended claims.

What is claimed is:

1. A method of weaving a fabric with a laid-in selvedge in a loom, comprising the following steps:

a) forming a first open front shed of first warp threads and of second warp threads, so as to provide a normal shed opening angle ($\alpha$) between respective upper ones and respective lower ones of said first warp threads in said first open front shed, and to provide a limited shed opening angle ($\alpha 1$) between respective upper ones and respective lower ones of said second warp threads in said first open front shed, wherein said limited shed opening angle ($\alpha 1$) is smaller than said normal shed opening angle ($\alpha$);

b) inserting a first weft thread into said first open front shed;

c) binding-in said first weft thread by closing said first open front shed, wherein said first weft thread has a laterally protruding free end;

d) forming a second open front shed of said first warp threads and said second warp threads, so as to provide said normal shed opening angle ($\alpha$) between respective upper ones and respective lower ones of said first warp threads in said second open front shed, and to provide said limited shed opening angle ($\alpha 1$) between respective upper ones and respective lower ones of said second warp threads in said second open front shed;

e) laying-in said free end of said first weft thread into said second open front shed;

f) inserting a second weft thread into said second open front shed; and g) binding-in said second weft thread and said free end of said first weft thread together by closing said second open front shed.

2. The method according to claim 1, wherein said laying-in of said step e) comprises pneumatically blowing said free end of said first weft thread into said second open front shed using an air jet.

3. The method according to claim 1, further comprising a step of beating-up said first weft thread against a beat-up edge of said fabric being woven before said step c), and a step of beating-up said second weft thread and said free end of said first weft thread against said beat-up edge before said step g).

4. The method according to claim 1, wherein said steps a) and c) are respectively carried out so that said second warp threads are selvedge warp threads that form said laid-in selvedge having a selvedge width along an edge of said fabric and said first warp threads are fabric body warp threads that form a main body of said fabric, and so that said limited shed opening angle ($\alpha 1$) is provided along said selvedge width and said normal shed opening angle ($\alpha$) is provided along a weaving width of said main body of said fabric.

5. The method according to claim 4, wherein said step e) is carried out so that said free end is laid into said second open front shed to the extent of a laying-in depth corresponding to said selvedge width.

6. The method according to claim 1, wherein said steps a) and d) each respectively comprise using a common shedding mechanism for all of said first and second warp threads for shedding said first warp threads and said second warp threads simultaneously and uniformly to a common maximum shedding deflection for all of said first and second warp threads directly at said common shedding mechanism.

7. The method according to claim 6, wherein said steps a) and d) each respectively further comprise constraining a shedding deflection range of said second warp threads between stationary upper and lower limit members at a location between said common shedding mechanism and a bound-in edge of said fabric being woven.

8. The method according to claim 1, wherein said loom is an air jet loom including a weaving reed with a weft insertion channel therein and at least one air jet nozzle arranged to direct an air jet along said weft insertion channel, wherein said inserting of said steps b) and f) comprises directing an air jet along said weft insertion channel to carry respectively said weft thread along said channel, and further comprising adjusting said limited shed opening angle ($\alpha 1$) to be greater than an angle subtended by a vertical channel height of said weft insertion channel.

9. The method according to claim 1, wherein said loom is a mechanical insertion loom including a mechanical weft insertion device, wherein said inserting of said steps b) and f) comprises carrying respectively said weft thread using said mechanical weft insertion device, and further comprising adjusting said limited shed opening angle (al) to be greater than an angle subtended by a vertical height of said mechanical weft insertion device.

10. The method according to claim 1, further comprising a step of adjusting said limited shed opening angle ($\alpha 1$).

11. The method according to claim 1, further comprising providing a total set of warp threads including said first warp threads and said second warp threads, and adjusting which threads of said total set are included among said first warp threads provided with said normal shed opening angle ($\alpha$) and which threads of said total set are included among said second warp threads provided with said limited shed opening angle ($\alpha 1$).

12. The method according to claim 1, wherein said steps a) and d) further comprise adjusting a height of said upper ones and said lower ones of said second warp threads in said respective open front shed relative to a weaving plane defined by a plane of said fabric being woven.

13. The method according to claim 1, wherein said loom comprises a shedding mechanism and a weaving reed, and wherein said steps a) and d) each respectively comprise deflecting said upper ones and said lower ones of said second warp threads mutually toward each other at a location between said shedding mechanism and said weaving reed.

14. In a loom system that has a machine frame, a shedding mechanism, a weaving reed extending along a weaving width, a selvedge laying-in device, upper and lower warp threads, and weft threads, and that is adapted to weave said upper and lower warp threads with said weft threads to form a woven fabric having a laid-in selvedge and a beat-up edge defined by a beat-up position of said weaving reed, an improvement comprising a shed opening limit device that comprises a support arm secured to said machine frame, and a first prong and a second prong that are attached to said support arm and that extend parallel and spaced apart relative to each other from said support arm in a direction of said weaving width, wherein said first prong and said second prong are arranged at a location between said shedding mechanism and said weaving reed, wherein said first prong and said second prong each respectively have a length in said direction of said weaving width that corresponds at least to a width of said laid-in selvedge, and wherein at least some of said upper and lower warp threads which form said laid-in selvedge are received and guided between said first prong and said second prong, and wherein a positive open limited shed opening angle ($\alpha 1$) defined between said first prong and said second prong from said beat-up position is less than a normal shed opening angle ($\alpha$) defined between maximum upper and lower warp deflections of said shedding mechanism from said beat-up position.

15. The improvement in the loom system according to claim 14, further comprising adjustable attachment means attaching said first and second prongs to said support arm and adjustable securing means securing said support arm to said machine frame, whereby said location of said first prong and said second prong is adjustable in an X-direction, a Y-direction and a Z-direction.

16. The improvement in the loom system according to claim 14, wherein said support arm is selectively movably secured to said machine frame so as to enable adjusting a position of said limit device in an X-direction, a Y-direction and a Z-direction relative to said machine frame.

17. The improvement in the loom system according to claim 14, wherein said first prong and said second prong are adjustably pivotably attached to said support arm to enable said first and second prongs to pivot so as to adjust a spacing distance between said first prong and said second prong.

18. The improvement in the loom system according to claim 14, wherein each one of said prongs has a substantially circular cross-section.

19. The improvement in the loom system according to claim 14, wherein said prongs respectively have respective cross-sections with respective rounded contour surfaces facing toward each other.

20. The improvement in the loom system according to claim 14, wherein said first prong is arranged directly vertically above said second prong.

21. The improvement in the loom system according to claim 14, wherein said respective length of said first and second prongs in said direction of said weaving width is equal to said width of said laid-in selvedge.

22. The improvement in the loom system according to claim 14, wherein said first and second prongs are immovably but releasably fastened to said machine frame.

23. In a loom system that has a machine frame, a shedding mechanism, a weaving reed extending along a weaving width, a selvedge laying-in device, upper and lower warp threads, and weft threads, and that is adapted to weave said upper and lower warp threads with said weft threads to form a woven fabric having a laid-in selvedge and a beat-up edge defined by a beat-up position of said weaving reed, an improvement comprising a shed opening limit device that comprises a support arm secured to said machine frame, and a first prong and a second prong that are attached to said support arm and that extend parallel and spaced apart relative to each other from said support arm in a direction of said weaving width, wherein said first prong and said second prong each respectively have a length in said direction of said weaving width that corresponds at least to a width of said laid-in selvedge, and wherein some of said upper and lower warp threads which form said laid-in selvedge are received and guided between said first prong and said second prong, and wherein said first prong comprises a first rod with a first free end portion opposite said support arm, said second prong comprises a second rod with a second free end portion opposite said support arm, and said first and second free end portions are respectively angled away from each other.

* * * * *